US005864958A

United States Patent [19]

Giddens

[11] Patent Number: 5,864,958

[45] Date of Patent: Feb. 2, 1999

[54] REAR SIGHT FOR BOW

[75] Inventor: David Giddens, 609 Hwy 98 East, East Point, Fla. 32328

[73] Assignees: Bruno Kolb, Bensenville, Ill.; David Giddens, East Point, Fla.

[21] Appl. No.: 795,238

[22] Filed: Feb. 10, 1997

[51] Int. Cl.[6] ..... F41G 1/467; F41B 5/14

[52] U.S. Cl. ..... 33/265; 124/87

[58] Field of Search ..... 33/265; 124/87, 124/88, 89, 86

[56] References Cited

U.S. PATENT DOCUMENTS

| | | | |
|---|---|---|---|
| 3,450,122 | 6/1969 | Diamond . | |
| 3,477,130 | 11/1969 | Egan . | |
| 4,162,579 | 7/1979 | James | 33/265 |
| 4,215,484 | 8/1980 | Lauffengurger | 33/265 |
| 4,215,485 | 8/1980 | Mesler | 33/265 |
| 4,263,718 | 4/1981 | Smith . | |
| 4,317,288 | 3/1982 | Yasui . | |
| 4,462,163 | 7/1984 | Tentler . | |
| 4,524,591 | 6/1985 | Montgomery | 33/265 |
| 4,570,352 | 2/1986 | Leal . | |
| 4,662,347 | 5/1987 | Carlton | 33/265 |
| 4,669,196 | 6/1987 | Kersey . | |
| 4,711,036 | 12/1987 | Morris . | |
| 4,715,126 | 12/1987 | Holt . | |
| 4,915,088 | 4/1990 | Powers | 33/265 |
| 4,982,503 | 1/1991 | Land | 33/265 |
| 5,579,752 | 12/1996 | Nelson et al. | 33/265 |
| 5,632,091 | 5/1997 | Brion et al. | 33/265 |

*Primary Examiner*—Christopher M. Fulton
*Attorney, Agent, or Firm*—Robert L. Marsh

[57] ABSTRACT

A rear sight is provided for attachment to a bow which has been fitted with a forward bow sight of the type having a pin, the distal end of which can be aligned with a target to aim an arrow. The rear bow sight includes an arm having a forward and rearward end, the forward end being mounted on the bow and the rearward end has a second pin thereon. The distal end of the first pin, and the distal end of the second pin, are sighting points for aiming an arrow to be launched at a target by the bow.

1 Claim, 2 Drawing Sheets

REAR SIGHT FOR BOW

The present invention relates to archery, and the sighting of bows, and in particular to a rear sight which is usable in combination with a forward sight having a pin, the distal end of which the archer aligns with the target to aim an arrow.

BACKGROUND OF THE INVENTION

It is well known that sights may be positioned on bows to aim the arrow shot therefrom. Bow sights are shown in U.S. Pat. Nos. 4,711,036; 4,669,196; 4,662,347; 4,317,288; 3,477,130; 3,450,122; 4,715,126; 4,263,718 and 4,462,163. A rear bow sight is shown in U.S. Pat. No. 4,570,352.

The most common bow sight includes a mounting bracket for retaining a sighting point such as the distal end of a pin, and a small loop which is fitted along the length of the bow string. To aim the bow, the archer sights his eye through the loop on the bow string and aligns the sighting pin over his target and centers the sighting point and target in the loop to aim the arrow.

The aiming of an arrow requires not only sighting on the target before the archer releases the arrow from the bow, but requires that the archer maintain the bow at its proper orientation while the arrow is being propelled by the forward moving bow string. The aim of the arrow will be lost if there is movement of the bow while the arrow is being propelled by the bow string. A bow sight which requires the archer to aim through a loop or other object attached to the string cannot maintain his aim while the arrow is being launched, and, therefore, the accuracy of the shot is dependent upon the archer's ability to blindly retain his bow's position while the arrow is launched.

Another problem with bow sights requiring an archer to align the tip of a pin and the target in the center of a loop on a bow string occurs in poor lighting. In poor lighting conditions, the archer cannot distinguish the boundaries of the field of vision established by the loop on the bow string, and cannot tell when the pin and target are in the center of the field of vision.

Another problem with sighting a bow arises from the differences between the arrows used in the bow. At the rear end of the arrow is a longitudinal slot into which the bow string is fitted. Frequently, the slot in the arrow is narrower than the width of the bow string such that the arrow grips the bow string. Some arrows grip the bow string more tightly than others. When an arrow that tightly grips a bow string is shot from a bow, the arrow will retain its grip after the bow string passes the relief position of the bow and will cause the arrow to decelerate before it is finally separated from the bow string. Arrows which more tightly grip a bow string will have a lesser initial speed than arrows with a loose grip, and, therefore, the flight of one arrow is not the same as the flight of another.

It would be desirable, therefore, to provide a bow sight which could be used in combination with a pin of the type on existing bow sights, to aim an arrow which would not be lost once the sting is released and would not require the archer to sight through a small hole. It would also be desirable to provide a device for releasing an arrow from a bow string after the bow string has passed the relief position.

SUMMARY OF THE INVENTION

Briefly, the invention is embodied in a rear bow sight for attachment to a bow which has been fitted with a forward bow sight of the type having a sighting point, which may be cross hairs or the distal end of a pin which can be aligned with a target to aim an arrow. The rear bow sight includes an arm having a forward and rearward end, the forward end being mounted on the bow and the rearward end having a retainer for retaining a rear sighting point, which may also be cross hairs or a pin. The rear sighting point is positioned on the retainer and aligned with the first sighting point such that an archer will use the two sighting points for aiming an arrow to be launched at a target by the bow.

BRIEF DESCRIPTION OF THE DRAWINGS

A better understanding of the present invention will be had by a reading of the detailed description of the preferred embodiment taken in conjunction with the drawings wherein.

DETAILED DESCRIPTION OF A PREFERRED EMBODIMENT

Figure 1:
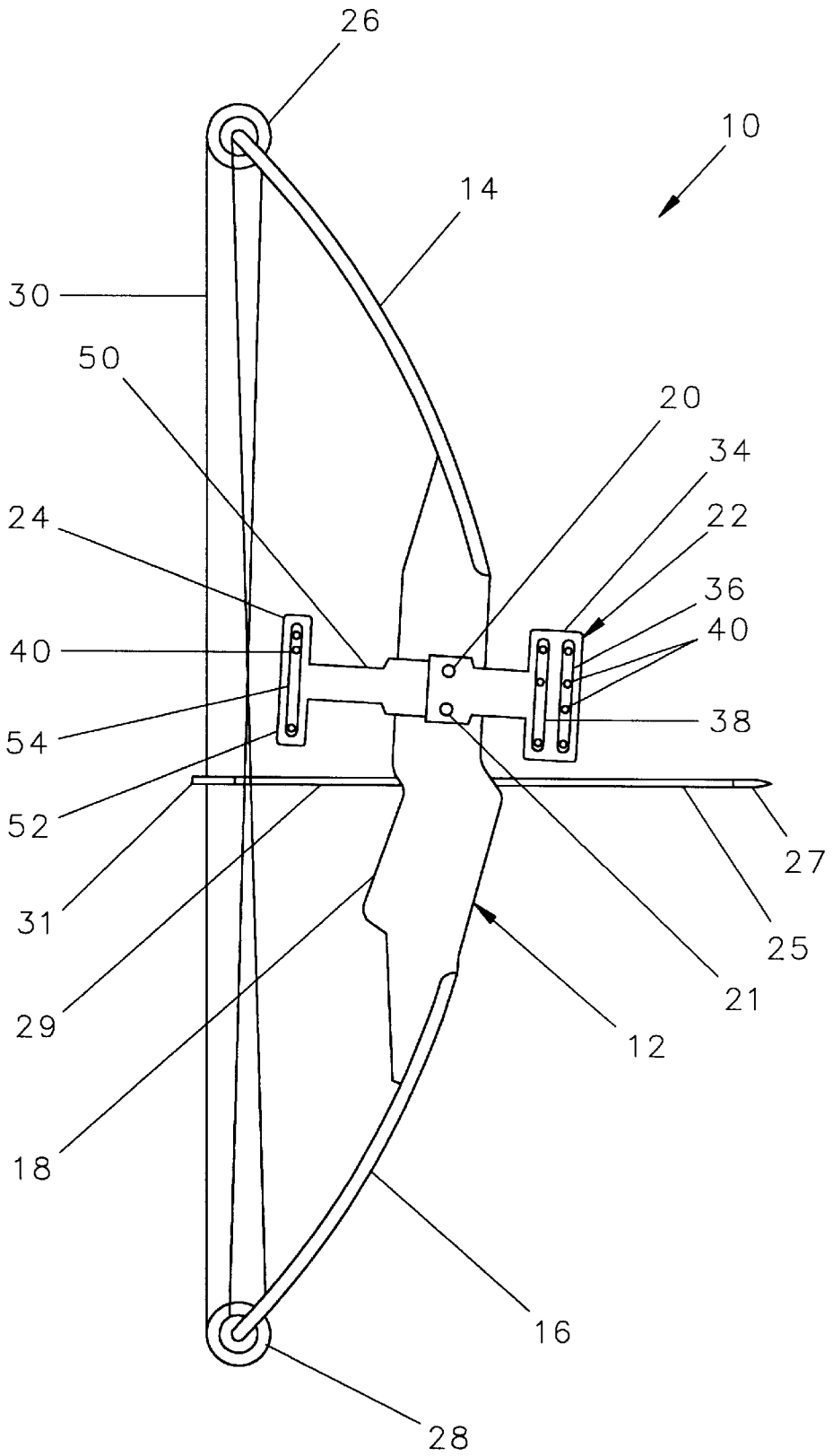
FIG. 1 is a side view of a compound bow fitted with a rear sight in accordance with the present invention with an arrow fitted in the bow.
Figure 2:
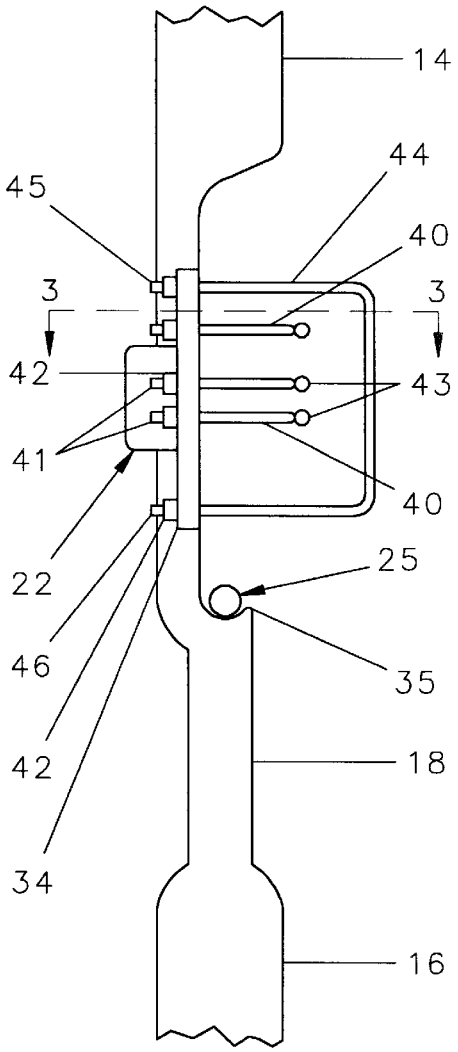
FIG. 2 is an enlarged fragmentary front view of the bow and sight shown in FIG. 1.
Figure 3:
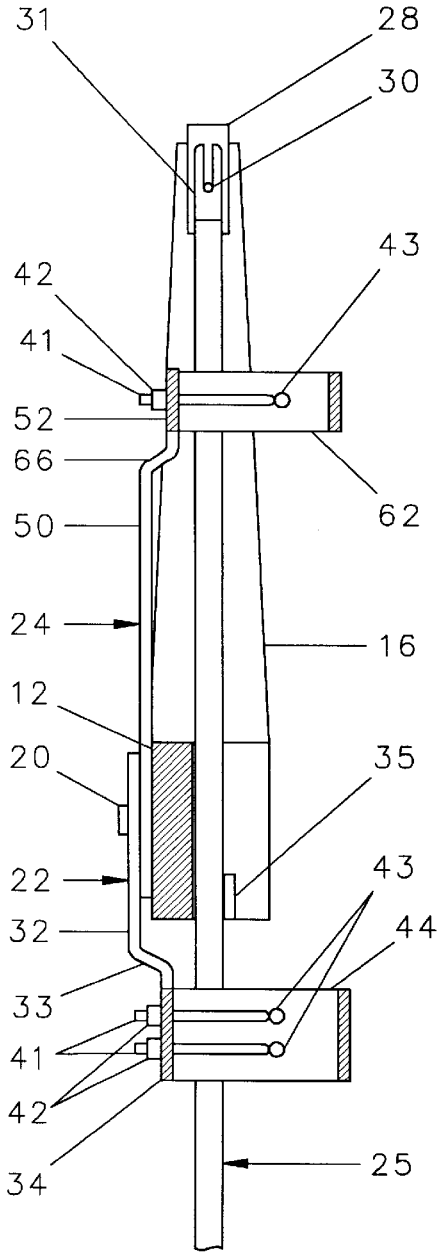
FIG. 3 is a cross-sectional view of the bow and sight shown in FIG. 1 taken through line 3—3 of FIG. 2.

Referring to FIGS. 1, 2 and 3, a compound bow 10 has a central portion 12 to which is attached a bendable upper arm 14 and a bendable lower arm 16. The lower half of the central portion 12 comprises a hand grip 18 and the upper half has retaining holes in which retaining bolts 20, 21 are inserted for retaining a forward bow sight 22 and a rear bow sight 24 in accordance with the present invention.

For the purpose of this discussion, the bow 10 and the arrow will be described with respect to the orientation shown in FIG. 1 in which the upper arm 14 extends upwardly, the lower arm extends downwardly, and the arrow shown strung in the bow is pointed forwardly.

At the distal end of the upper arm 14 is a first cam and roller assembly 26, and at the distal end of the lower arm 16 is a second cam and roller assembly 28. Extending around the first and second assemblies 26, 28 and between the distal ends of the upper and lower arms 14, 16 is a bow string 30.

An arrow 25 is shown strung within the bow, and the arrow has a tip 27, a shaft 29 and at the rear end, a clip 31 having a longitudinal slot therein into which the bow string 30 is received. The shaft of the arrow is positioned on an arcuate rest 35 on the central portion 12 of the bow.

The bow 10 is depicted as being in the relief condition, that is, the bow string 30 has not been drawn backward to launch the arrow 25. When the string 30 is forcibly drawn backward, the arms 14, 16 are bent and the cams 26, 28 rotated in response to the force against the string 30.

The forward bow sight 22 has an arm 32 with a dog leg 33 along its length, and the rearward end of the arm has a pair of transverse holes aligned to receive the bolts 20, 21 which thread into the central portion 12 of the bow 10. The forward end of the arm 32 has an enlarged planar portion 34 with two vertical slots 36, 38 therein. Fitted into the slots 36, 38 are a plurality of pins 40—40, each of which has a threaded base portion 41—41, which extends through the associated slot and is retained by a nut 42—42, and at the opposite end thereof a small sighting sphere 43—43. As best shown in FIGS. 2 and 3, extending around the pins 40—40 is a protective U-shaped shield 44 and extending from the distal ends of the shield are threaded studs which fit within the ends of the slots 36, 38 and are also retained by nuts 42—42.

The rear bow sight 24 also has an elongate arm 50, the forward end of which has transverse holes spaced to receive the same bolts 20, 21 which retain the forward bow sight 22 to the central portion 12 of the bow. The arm 50 extends rearward from the central portion 12 of the bow, and the rearward end of the arm has an enlarged portion 52 having an elongate vertical slot 54 therein. The slot 54 has dimensions which are similar to those of slots 36, 38 of the forward sight 22, and is adapted to receive another sighting pin 40. Like the forward pins, the rear pin is retained in the slot 54 at its desired location by tightening a nut 58 on a threaded base portion thereof.

As best shown in FIG. 3, the rear sight 24 has a dog leg 66 in the length thereof to offset the orientation of the rearward end 68 of the arm 50 such that the rearward end 68 is in alignment with the offset forward end portion 34 of the forward sight 22. The sighting spheres 43 of the pins 40—40 can, therefore, be used to sight an the arrow 25 strung on the bow.

Extending around the rear sighting pin 40 is a second U-shaped shield 62, which has threaded studs at the distal ends of the legs thereof that extend through the slot 54 and are retained on the rear sight 24 by nuts 64 at the ends thereof.

To sight the bow, an archer will place an arrow 25 transverse of the length of the bow 10 with the rearward end fitted on the bow string 30, as shown. While holding the bow 10 by the hand grip 18 with an extended arm he will draw the arrow 25 and the bow string 30 backward and position it to align the sphere 43 of the rear pin with one of the spheres 43 of a forward pin, and with the target to aim the arrow. A plurality of forward pins 40 are positioned in the slots 36, 38 with the different pins positioned to correspond to different elevations of the bow as required to compensate for the drop of the arrow at a number of ranges. The archer, therefore, will align the sphere 43 of the rear bow sight 24 with the appropriate sphere 43 of the forward bow sight. Once the arrow is released, the archer will continue to retain the spheres 43, 43 in alignment with the target until after the arrow has left the bow.

Some of the arrows are manufactured such that the clip at the rear end of the arrow more tightly fits around the bow string than the clips for other arrows, and as a result, different arrows will release from a bow at different positions as the bow string is moved forward to launch the arrow. A clip which fits tightly around the string of a bow will remain attached to the string after the string 30 has passed the release position as shown in FIG. 1. After the bow string has passed the release position, the bow string will decelerate rapidly, and an arrow which remains clipped to the bow string will lose some of the speed obtained from the bow. Where the bow 10 is fitted with the rear sight 24 in accordance with the present invention, however, the legs of the U-shaped shield 62 will block forward movement of the bow string 30 after the bow string moves a short distance forward of the relief position shown in FIG. 1. An arrow having a clip which tightly fits around the bow string will be released from the bow string a short distance after the bow string passes the relief position when the string 30 strikes the rear shield 62.

To shoot a bow, an archer will retain the handle of the bow in one hand with his arm outstretched and holding the distal end of the arrow and the string in the other hand, draw the clip of the arrow against his cheek. The archer, therefore, will draw a bow to the same tension each time he shoots an arrow. Since all arrows fired by an archer will be released at substantially the same position as the arrow is shot from the bow, all arrows shot by the archer will be launched at substantially the same speed and an archer can become familiar with the trajectory of his arrow. The archer can then position the pins within the forward and rearward sights of the bow to accurately aim an arrow toward a target.

It should be appreciated that whereas the forward and the rear sighting points are described herein as being the distal ends of pins, any of a number of configurations of sighting points are available, and the invention is usable with any device which establishes a sighting point.

While the present invention has been disclosed in connection with one embodiment, it will be apparent to those skilled in the art that many changes and modifications may be made without departing from the true spirit and scope of the invention. It is the purpose of the appended claims to cover all such changes and modifications which fall within the true spirit and scope of the invention.

What is claimed:

1. The method of aiming an arrow in a bow at a target comprising the steps of, providing a forward bow sight having a forward sighting point, attaching said forward bow sight to said bow, providing a rear bow sight having a rear sighting point, and a U-shaped shield extending around said rear sighting point, attaching said rear bow sight to said bow behind said forward bow sight with said sighting points aligned to sight an arrow in said bow, and said U-shaped shield positioned to interrupt as movement of a bow string forward of a relief position when an arrow is shot from said bow, and aligning said first forward sighting point and said rear sighting point with said target to aim said arrow at said target.

* * * * *

UNITED STATES PATENT AND TRADEMARK OFFICE

CERTIFICATE OF CORRECTION

PATENT NO. : 5,864,958
DATED : February 2, 1999
INVENTOR(S) : David Giddens

It is certified that error appears in the above-indentified patent and that said Letters Patent is hereby corrected as shown below:

In column 1, line 59, after "the" first occurrence delete "sting" and substitute --string--.

In column 4, line 45, after "interrupt" delete "as."

Signed and Sealed this

Twenty-seventh Day of July, 1999

*Attest:*

*Attesting Officer*

Q. TODD DICKINSON

*Acting Commissioner of Patents and Trademarks*